US005836162A

United States Patent [19]

Haynes

[11] Patent Number: 5,836,162

[45] Date of Patent: Nov. 17, 1998

[54] FEEDWATER HEATER DRAIN RECYCLE SYSTEM

[75] Inventor: Christopher J. Haynes, Portsmouth, R.I.

[73] Assignee: Power Software Associates, Inc., Portsmouth, R.I.

[21] Appl. No.: 693,994

[22] Filed: Aug. 8, 1996

[51] Int. Cl.[6] ..... F01K 7/22

[52] U.S. Cl. ..... 60/663; 60/678

[58] Field of Search ..... 60/660, 663, 665, 60/678, 679, 684

*Primary Examiner*—Noah P. Kamen

*Attorney, Agent, or Firm*—Ross,Ross & Flavin

[57] ABSTRACT

A system for draining condensed steam from a closed high pressure feedwater heater installed in a steam turbine power generation cycle, and recycling the drains into the feedwater system at a point between the inlet to the main feedwater pump and an immediately adjacent closed feedwater heater, with controls for regulating the level in the high pressure heater, in conjunction with the normal cascade drain system, and with provisions for preventing the backflow of feedwater into the drain system and then into the high pressure feedwater heater.

5 Claims, 4 Drawing Sheets

FEEDWATER HEATER DRAIN RECYCLE SYSTEM

BACKGROUND OF THE INVENTION

1. Field of the Invention

The present invention relates to electric generating power plants using steam turbines, and particularly to an improved method for regenerating the heat in the condensate draining from feedwater heaters.

2. Description of the Prior Art

A typical power plant generates about 580 megawatts of electricity. There are hundreds of power plants of this size or greater in existence.

FIG. 1 illustrates schematically a prior art power plant generating about 580 megawatts of electricity.

FIG. 1 is the type of schematic known as a heat balance diagram by those who practice the arts of power plant design and operation. A heat balance shows only important features of the power cycle. Flows and fluid properties are shown at various points in the cycle. Those shown on FIG. 1 were calculated by a computerized simulation that predicts how the power plant will perform under specified conditions. Such simulations are widely used by those proficient in the art and have been proven to accurately predict plant operation.

Shown in FIG. 1 are the mass flows (designated by the symbol W, and given in units of pounds per hour), pressures (designated by the symbol P, and whose units are pounds per square inch, absolute, or Psia), temperatures (designated by the symbol F, and whose units are degrees fahrenheit), and enthalpies, (designated by the symbol H, and whose units are Btu's per pound mass). Enthalpy is a term familiar to those proficient in the science of thermodynamics, and can be defined as the heat content of a fluid, with some sacrifice of scientific rigor involved in this simplified definition.

Steam is raised in a boiler 10 through the burning of fuel, such as coal, and flows via a line 11 to a high pressure turbine 12, which it enters at steam conditions of 2400 Psia, 1000 F., exhausting from this turbine at 661 Psia, 664 F., via a line 13 back to boiler 10 where it is reheated, from where it flows via a line 15 to an intermediate pressure turbine 14, which it enters at 595 Psia, 1000 F., and exits via a line 17 to a low pressure turbine 16, from which it is exhausted via a line 19 to a condenser 18, which is under high vacuum (1 Psia) where it is condensed into water by surrendering its latent heat to water (not illustrated) pumped from the ocean, a river, or a cooling tower.

High pressure turbine 12, intermediate pressure turbine 14, and low pressure turbine 16 share a common shaft 8 which is coupled to and turns the rotor of a generator 20, generating 579,020 kilowatts of electricity.

A condensate pump 22 extracts the condensate from the bottom of condenser 18 via a line 21 at a temperature of 101.1 F., increasing its pressure to 100 Psia. After flowing through condensate pump 22 it is called "Feedwater" and flows via a line 23 through a low pressure closed feedwater heater 24, in which it is heated to a temperature of 155.0 F., in which its pressure drops to 80 Psia.

The feedwater flows from closed feedwater heater 24 via a line 25 to another closed low pressure feedwater heater 26 in which it is heated to 220.2 F. and in which its pressure drops to 60 Psia because of friction of the feedwater flowing through the heater tubes, not shown; from heater 26, the feedwater flows via a line 27 to an open feedwater heater 28, where it is heated to 277.7 F.

Closed feedwater heaters are shell and tube heat exchangers with steam filling the shell and surrounding the tubes through which the feedwater flows. The feedwater and steam do not come into direct contact, but are separated by the tubes, giving the term "closed" to this type of heater. The steam condenses, heating the feedwater to a temperature that is within a few degrees fahrenheit of the saturation temperature of the steam. The condensate collects in a pool at the bottom of the heater from where it escapes through a drain. In low pressure feedwater heater 26, for example, the saturation temperature of steam at 19 Psia is found in published steam tables to be 225.2 F., and the feedwater leaving that heater has been heated to 220.2 F. In the process, 179,418 lb of steam per hour are condensed. The temperature of the condensate draining from the heater is 165.0 F.

Open feedwater heaters are large tanks filled with steam into which the feedwater is sprayed. The steam condenses onto the droplets of the sprayed feedwater, heating them to the saturation temperature of the steam. The feedwater, now mixed with condensed steam collects in the bottom of the tank, from where it escapes through a feedwater outlet line.

Feedwater leaves open feedwater heater 28 via a line 29 and flows to a booster pump 30, from which it is pumped via a line 31 through an intermediate pressure closed feedwater heater 32, in which it is heated to 335.4 F., and from which it flows via a line 33 into a feedpump 34.

From feedpump 34, the feedwater flows via a line 35 to and through a high pressure closed feedwater heater 36 in which it is heated to 410.3 F.

Feedwater flows from high pressure closed feedwater heater 36 via a line 37 to another high pressure closed feedwater heater 38 in which it is heated to 495.4 F. and flows from heater 38 via a line 39 to boiler 10, where it is raised into steam. The whole process is continuously repeated.

Steam is supplied to each heater by extraction pipes which connect between each heater and a respective turbine as follows: an extraction pipe 40 connects between low pressure turbine 16 and low pressure closed feedwater heater 24; an extraction pipe 42 connects between low pressure turbine 16 and low pressure closed feedwater heater 26; an extraction pipe 44 connects between low pressure turbine 16 and open feedwater heater 28; an extraction pipe 46 connects between intermediate pressure turbine 14 and intermediate pressure closed feedwater heater 32; an extraction pipe 48 connects between intermediate pressure turbine 14 and high pressure closed feedwater heater 36; and an extraction line 50 connects between high pressure turbine 12 and high pressure closed feedwater heater 38.

The heaters that operate at the higher temperatures are connected to one of the turbines at a point where the pressure of the steam inside the turbine is high, while those that operate at lower temperatures are connected to one of the turbines at a point where the pressure of the steam inside the turbine is low. For example, the highest temperature heater 38 is connected by extraction pipe 50 to the exhaust of high pressure turbine 12, where the pressure is 661 Psia, while the lowest temperature heater 24 is connected by extraction pipe 40 to a point in low pressure turbine 16, where the pressure is 5 Psia.

The draining condensate leaving each of the closed heaters 24, 26, 32, 36, and 38 is still quite hot, and this heat should be used properly to maximize the power plant's efficiency.

For example, the condensate draining from heater 38 is at 420.3 F. It would advantageously improve the efficiency of the power plant if this condensate could be recycled into the adjacent feedwater pipe 37 at the inlet to heater 38, where the temperature is 410.3 F. Unfortunately, the pressure in the feedwater pipe is much higher (2780 Psia) than the pressure of the condensate, which is close to the pressure of the steam entering the shell of heater 38 (641.2 Psia). A drain pump (not illustrated) would be necessary to recycle the draining condensate into the feedwater pipe. Such drain pumps are occasionally used in power plants, but their initial cost and high maintenance needs have prevented their universal adoption.

An alternative, common in the prior art, to recycling condensate drains into the adjacent feedwater pipe, is illustrated in FIG. 1. It involves routing the draining condensate from heater 38 through a drain system 52 which includes piping 53 and a control valve 54 into the next lower temperature heater 36. Heater 36 is at a pressure (271.6 Psia) that is below that of heater 38 (641.2 Psia), and consequently no pump is needed to force the water through drain system 52.

A level sensor 64 measures the level of the condensate collected in the pool at the bottom of heater 38 and sends a signal to a controller 66 which, in turn, opens or closes control valve 54 to regulate this level to an appropriate defined value. A signal circuit 65, usually transmitting a pneumatic or an electrical signal, interconnects level sensor 64, controller 66 and control valve 54.

This alternative to recycling the condensate drains to the adjacent feedwater pipe is inferior in its affect on plant efficiency, but has the merit of avoiding the problems of drain pumps.

In the shell of heater 36, the condensate entering from heater 38 through drain pipe 53 mixes with the condensate generated from the condensing of steam in heater 36, transferring a portion of its remaining heat to the feedwater flowing through heater 36, and leaves through a drain system 56 at a temperature of 350.6 F.

The condensate leaving heater 36 is cascaded through drain system 56, similar to drain system 52, which includes piping 57 and a control valve 58 into heater 32, with the level of condensate in the bottom of heater 36 being regulated by control valve 58 to a defined value actuated by a level sensor 68 and a controller 70. A signal circuit 69 interconnects level sensor 68, controller 70 and control valve 58.

A similar drain system 60, including piping 61 and a control valve 62 further cascades the drains from heater 32 into open feedwater heater 28. The level sensor and controller are not illustrated in FIG. 1.

A similar drain system 80, including piping 79 and a control valve 81 is used for recovering heat contained in the condensate draining from low pressure heater 26 to low pressure heater 24.

It is very advantageous to the owners of power plants to generate the largest possible amount of electricity while using the least possible amount of fuel. A power plant such as described above will generate enough electricity to supply the average needs of about 500,000 houses, and will burn about 5000 tons of coal per day. For such large scale power plants, inventions that offer even small improvements in the efficiency of the process, by means of ingenious modifications to existing power plant schematics, are diligently pursued by those proficient in the art. U.S. Pat. Nos. 5,404,724 (Silvestri), 5,038,568 (Gounder et al), 4,561,255 (Silvestri), 4,865,657 (Silvestri and Viscovich), and 3,173,267 (Takeda) are examples of such inventions.

SUMMARY OF THE INVENTION

The principal object of the invention is to economically improve the efficiency of steam power plants by improving the process by which the heat contained in condensate draining from feedwater heaters is regenerated.

In this invention, a drain recycle system consisting of piping and a control valve is installed to connect the prior art drain system that drains the feedwater heater downstream of the feedpump into the adjacent feedwater piping at the feedpump inlet. Under certain operating conditions, the pressure in the drain system is above the pressure in the adjacent feedpump inlet piping. Condensate will flow through the drain recycle system into the feedwater pipe, mixing with the feedwater before flowing into the inlet of the feedpump. The control valve will be opened and closed by a controller to maintain level in the shell of the heater located downstream of the feedpump at an appropriate defined value. It should be remembered from the preceding discussion that the most efficient use of condensate draining from a feedwater heater is to recycle it into the adjacent feedwater piping. This invention causes the condensate draining from a heater to be recycled into the feedwater piping, under certain operating conditions, without the need for a pump.

A further object of this invention is to assure that achieving the principal object of improving plant efficiency does not create undesirable consequences during operation. One such undesirable consequence would be the flooding of the shell of a feedwater heater with water. When the shell of a feedwater heater is filled with water, steam will not contact the tubes that carry the feedwater, and the functioning of the heater in heating feedwater is stopped.

An even more serious consequence can result if the feedwater heater shell should flood completely and continue to flood the extraction pipe back to the turbine. It is well known that a turbine can be destroyed by the quenching of its hot metal parts if water were to enter it through an extraction pipe while it is operating at full speed.

There will be occasions during operation of the power plant when the pressure in the feedwater piping at the feedpump inlet will be greater than the pressure in the adjacent drain system. During these occasions, draining condensate cannot flow through the recycle system into the feedwater piping.

During these occasions, a further feature of the invention will have the controller opening and closing the control valve installed in the prior art drain system, to maintain the level in the shell of the heater located downstream of the feedpump at some defined value that is slightly above the level at which the control valve in the recycle system operates. This will allow an alternate path for condensate draining from this heater when drains are unable to flow through the recycle system, and thus prevent the flooding of the heater caused by inability of the draining condensate to escape.

If the control valve of this invention should remain open during these occasions when the pressure in the feedwater piping at the feedpump inlet exceeds the pressure in the adjacent drain system, feedwater could backflow into the heater through the drain system rapidly flooding the heater and possibly filling the extraction pipe. A further feature of this invention, the inclusion of a check valve (a commonly used type of valve that allows flow in only one direction) in the recycle system will prevent this backflow with its possible unpleasant consequences.

The recycle system might create a further undesirable consequence during operation if some upset or failure of the feedwater heater downstream of the feedpump caused the temperature of its draining condensate to be unusually high. (The failure of certain internal dividing walls, or the rupture of a tube within the heater are some of the events that are known to cause a high drain temperature). This unusually hot condensate would be recycled into the feedpump inlet, where it would raise the temperature of the feedpump inlet excessively, possibly causing damage through cavitation or the failure of pump seals. To avoid this possibility, a further feature of this invention involves a temperature sensor installed in the drain piping. If the temperature in condensate flowing through the drain piping were to rise above a defined value, the temperature sensor would send a signal to the controller. The controller would close the control valve in the recycle system or, alternatively,would close a separate blocking valve installed in series with the control valve to prevent recycling the hot condensate.

DESCRIPTION OF THE PREFERRED EMBODIMENTS

Figure 1:
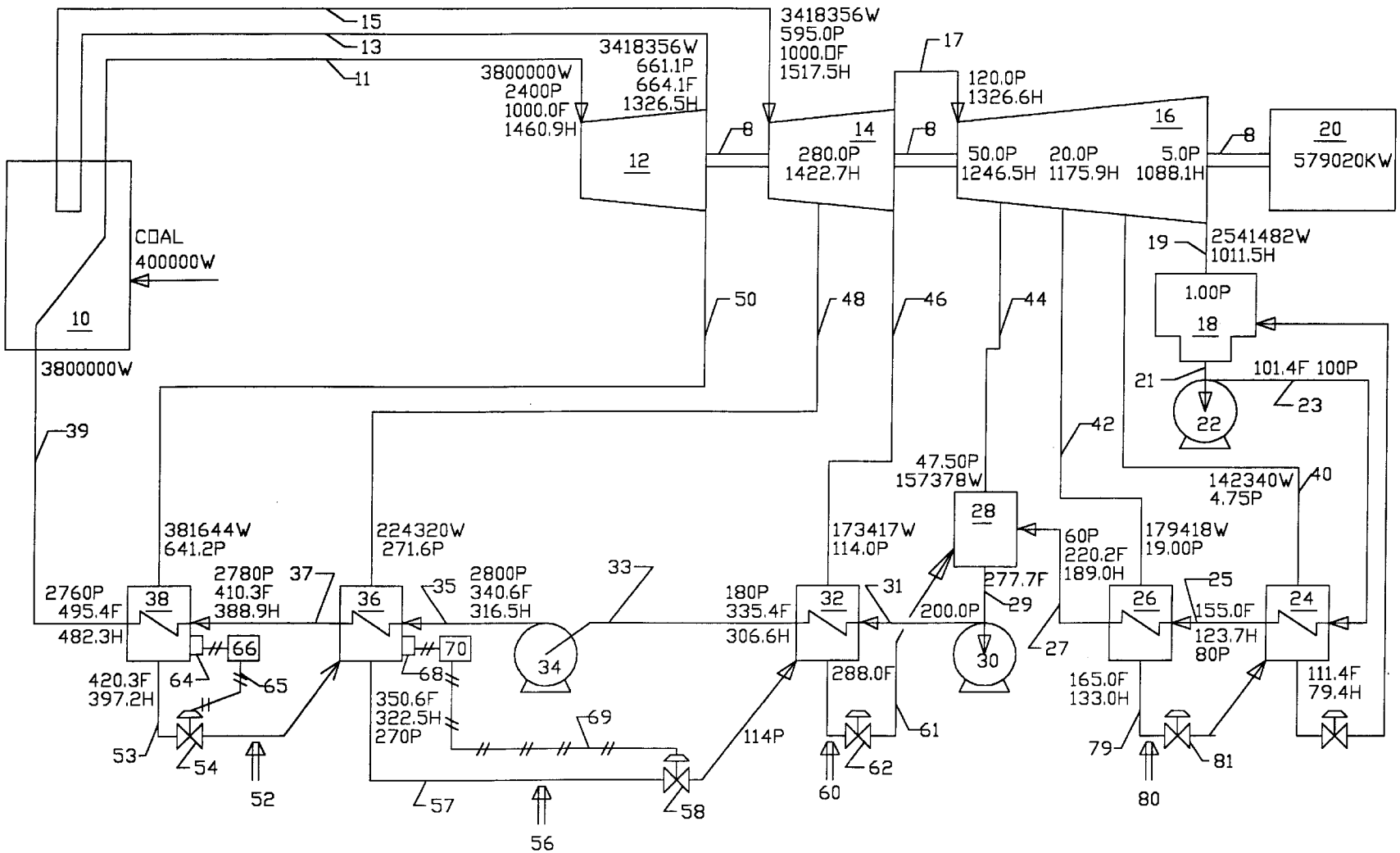
FIG. 1 (PRIOR ART)
FIG. 1 is a simplified,functional representation, called a heat balance diagram, of a typical prior art steam power plant.
Figure 2:
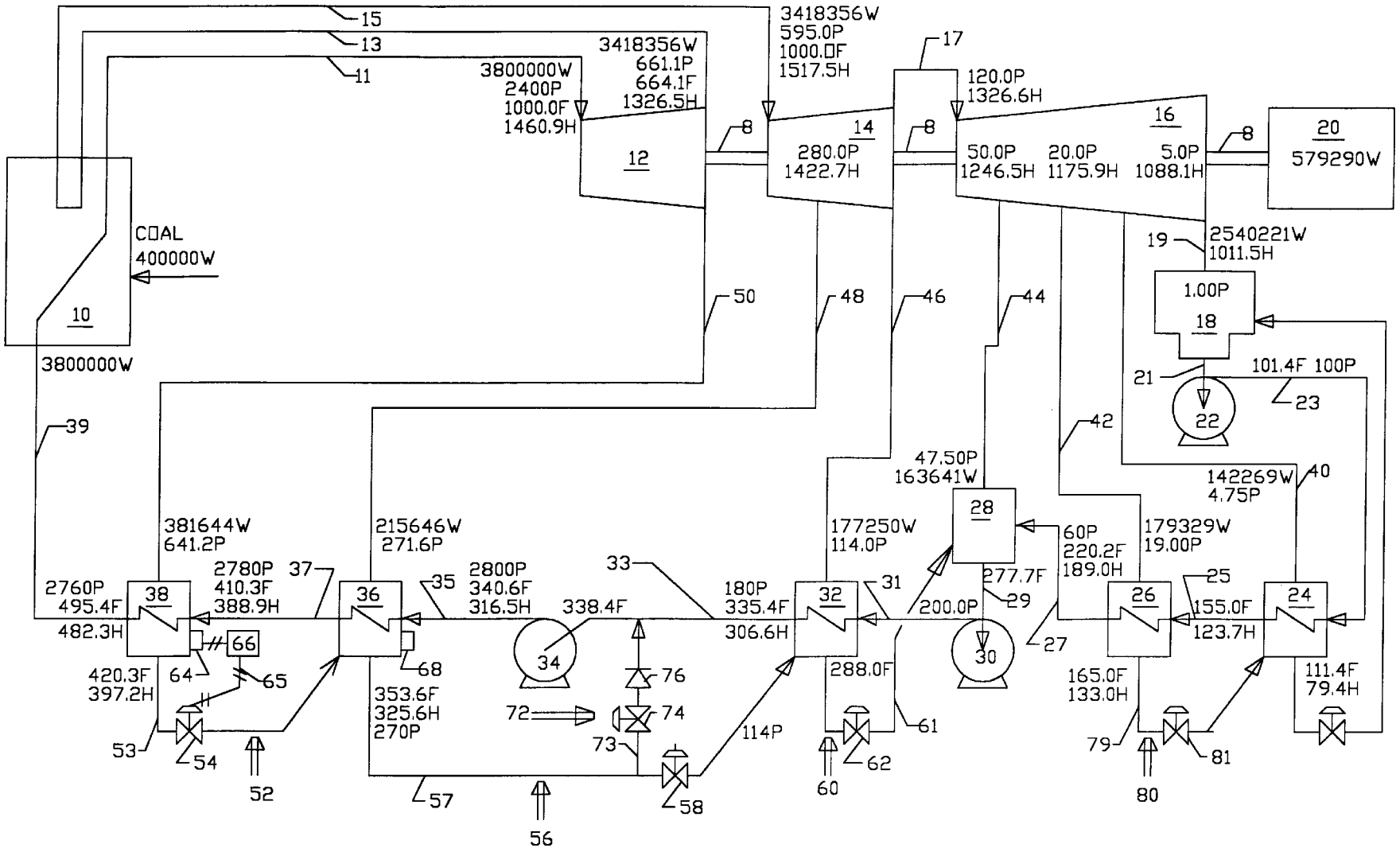
FIG. 2 is a heat balance diagram of the steam power plant shown in FIG. 1, modified in accordance with the present invention.

FIG. 2 is a heat balance schematic drawing illustrating the same power plant shown in FIG. 1, but with features of the present invention included. The coal flow to boiler 10 has the same value, 400,000 lb per hour, as the coal flow in FIG. 1. In consequence of burning coal at the same rate, the flows, pressures, and temperatures of the steam supplied by boiler 10 to high pressure turbine 12 and intermediate pressure turbine 14 have the same values as in FIG. 1.

In FIG. 2, a recycle system 72 is inserted in drain system 56 between high pressure closed feedwater heater 36 and intermediate pressure closed feedwater heater 32.

Recycle system 72 includes piping 73 which extends between piping 57 and line 33 and a recycle control valve 74 and a check valve 76 disposed in piping 73, before joining line 33 at the inlet of feedpump 34.

The portion of drain system 56 downstream of the connection to recycle system 72, which includes control valve 58, (hereinafter referred to as the normal control valve), has not been eliminated, but is inactive when recycle system 72 is in operation.

It should be noted that the pressure in the feedwater piping upstream of feedpump 34 is 180 Psia. The pressure in drain system 56 and recycle system 72 upstream of recycle control valve 74 is very close in value (270.0 Psia) to the pressure of the steam (271.6 Psia) in feedwater heater 36. When recycle control valve 74 is opened, condensate draining from heater 36 will flow through recycle system 72 through recycle valve 74 and check valve 76 into the feedwater piping at the inlet to feedpump 34. The recycling of condensate into the feedwater piping at the inlet to feedpump 34 raises the temperature of the feedwater from 335.4 F. to 338.4 F.

The electrical output of generator 20 is shown in FIG. 2 to be 579,290 kw. The comparable value in FIG. 1 is 579,020 kw. The increase, 270 kw, is the result of the operation of recycle system 72. This increase of 270 kw will be continuous whenever the power slant is operating under the conditions shown in FIG. 2. The continuous increase in output of 270 kilowatts, which is the average electrical consumption of about 270 homes, occurring without any increase in the consumption of coal would be of great advantage to the owner of the power plant.

The reason for the increase in output may be seen by comparing the steam consumptions of the various feedwater heaters shown in FIG. 2 with those shown in FIG. 1.

In FIG. 2, heater 36 consumes about 9000 lb per hour less steam than it did in FIG. 1 because the entering feedwater is hotter (343.6 F. versus 340.6 F.) and thus less heat is needed to increase its temperature to 410.3 F. at the outlet.

In FIG. 2, heater 32 uses about 3000 lb/hr more steam than in FIG. 1, and open feedwater heater 28 uses 6000 lb/hr more steam than in FIG. 1. The increase in steam consumption of heaters 32 and 28 is caused by the elimination of condensate draining from heater 36 as a source of heat, since the condensate has been recycled.

There is little or no change in the steam consumption of heaters 38, 26 and 24.

Summarizing these changes in steam consumption between FIG. 2 and FIG. 1, and noting their effects on flows through the various turbines, it is seen that in FIG. 2, 9000 lb/hr less steam is extracted from turbine 14 through extraction pipe 48 at a pressure of 280 Psia to supply heater 36. In FIG. 2, 3000 lb/hr more is extracted from turbine 14 at a pressure of 120 Psia through extraction pipe 46 to heater 32 and 6000 lb/hr more is extracted from turbine 16 at a pressure of 50 Psia through extraction pipe 44 to heater 28. The net effect in the turbines is that in FIG. 2, 9000 lb/hr more steam expands from 280 Psia to 120 Psia and 6000 lb/hr more steam expands from 120 Psia to 50 Psia. The increased amount of steam expanding in these portions of the turbines results in the production of more mechanical energy and thus more electricity being generated.

Figure 3:
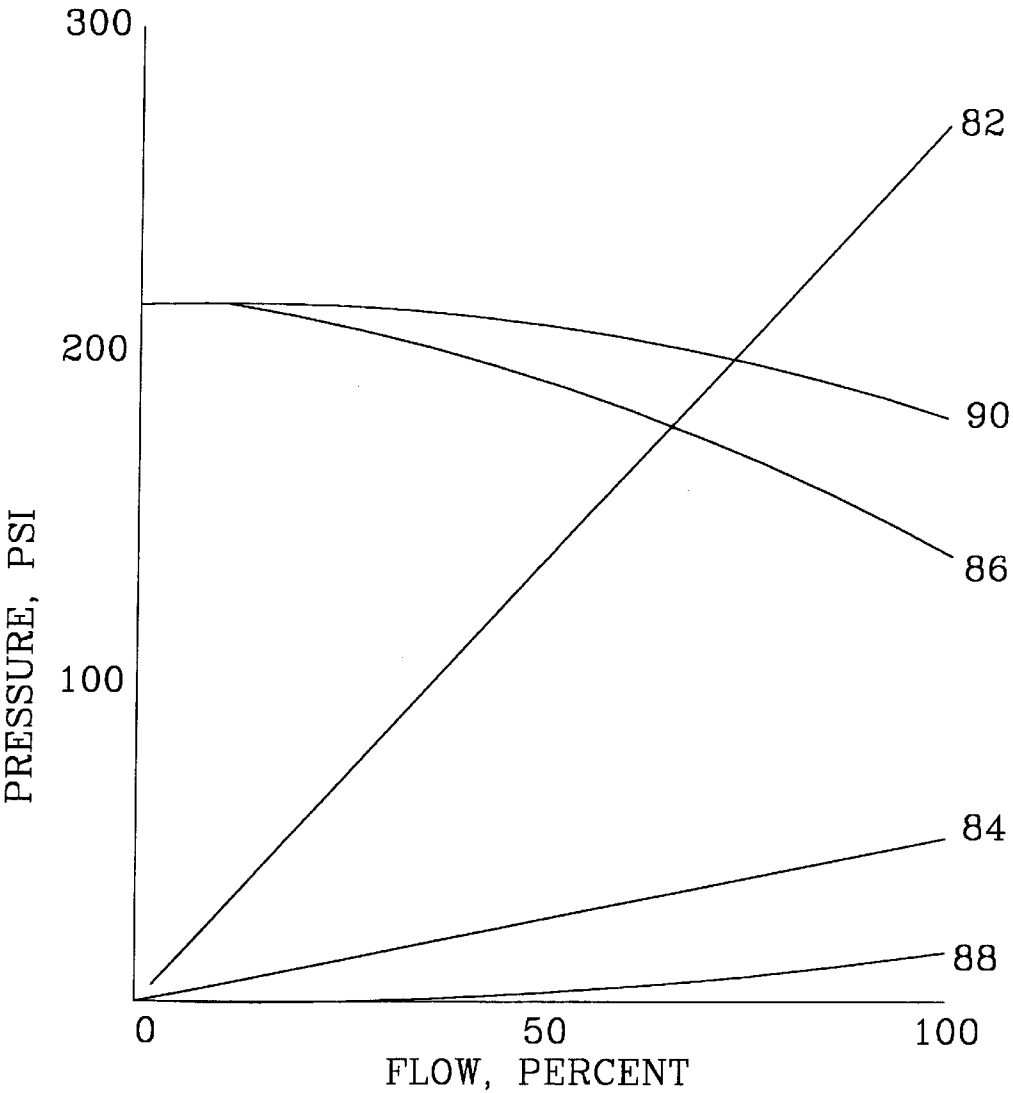
FIG. 3 is a set of curves showing pressures at various points in the power plant of the invention represented in FIG. 2.

Referring now to FIG. 3, the hydraulic aspects of the invention will be described. FIG. 3 illustrates the dependency on flow of various pressures in the cycle shown in FIG. 2. The 100 percent flow condition is that shown in FIG. 2.

Steam pressures are indicated by 82 and 84 at heater 36 and open feedwater heater 28 respectively and follow a rising straight line shape. (The pressure at the other heaters behave in a similar fashion, but these pressures are not relevant here.) This is in accordance with the normal behavior of steam turbines, well known to those proficient in the art of turbines, that pressure is closely proportional to flow. The pressure of the steam at a heater is equal to the pressure at the turbine, less a modest reduction due to the flow through the extraction pipe.

Also in FIG. 3, the pressure increase from inlet to outlet of booster pump 30 is indicated by 86. It is seen that this pressure increase rises as flow decreases, in accordance with the normal behavior of common centrifugal pumps, such as those used in power plants.

The pressure drop from inlet to outlet of feedwater heater 32 is indicated by 88. This pressure drop is proportional to flow squared, in accordance with the well known laws of friction of water flowing through pipes and tubes.

The pressure at the inlet to feedpump 34 is indicated by 90 and is equal to steam pressure 84 in heater 28, plus pressure increase 86 across booster pump 30, minus pressure drop 88 across heater 32.

Remembering that the pressure in drain system 56 and recycle system 72, upstream of recycle control valve 74, is nearly equal to the steam pressure 82 in heater 36, it can be seen that the pressure at the inlet to recycle system 72 is greater than the pressure 90 at the inlet to feedpump 34, at 100 percent flow. This pressure difference will cause condensate draining from heater 36 to flow through recycle system 72 into the inlet of feedpump 34.

However, when the flow is reduced below about 75 percent, the pressure upstream of recycle control valve 74 which is nearly equal to steam pressure 82, will be less than pressure 90 at the inlet to feedpump 34. Recycle system 72 will not function under these conditions. Check valve 76 prevents an undesirable backflow from the feedwater pipe through recycle system 72 into heater 36 under these conditions.

It will be noted that when flow drops below about 75 percent, and the recycle system 72 ceases to function, the invention gives no advantage to the owner of the power plant. Most power plants operate at or near 100 percent flow for much of the time, and the advantage of the invention to the owner of the plant during these times will still be great.

Figure 4:
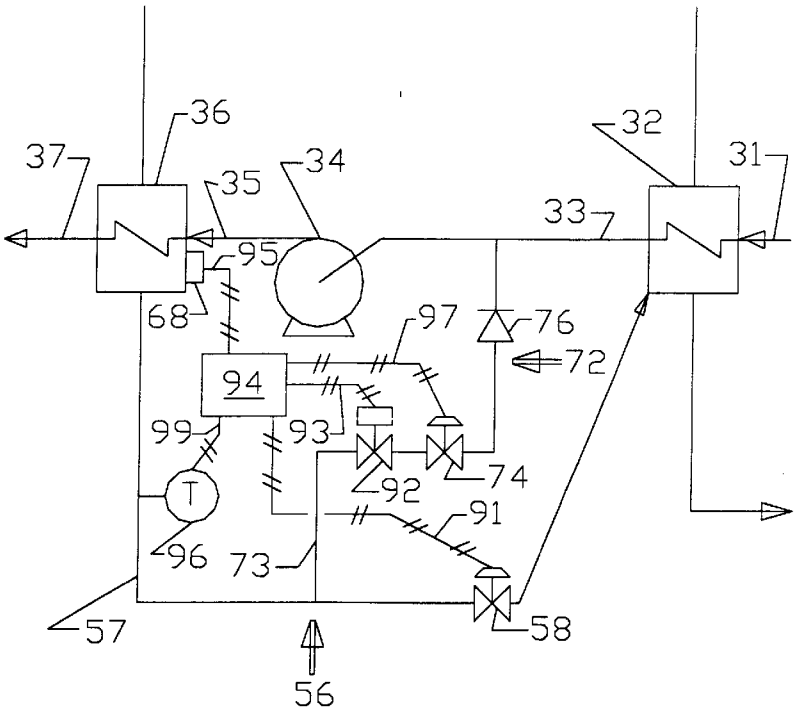
FIG. 4 is a simplified, functional representation of a recycle system and the control scheme used in the present invention for regulating the flow of condensate draining from a feedwater heater.

FIG. 4 illustrates a control system needed as part of this invention to assure safe and proper operation of the power plant.

Level sensor 68 measures the level of the pool of collected condensate at the bottom of heater 36.

A temperature sensor 96 measures the temperature of the condensate draining from heater 36 through piping 57 of drain system 56, upstream of the connection to recycle system 72.

Level sensor 68 is connected to a controller 94 by a signal circuit 95 and temperature sensor 96 is connected to piping 57 of drain system 56 and by a signal circuit 99 to controller 94, with both sensors 68 and 96 sending signals to controller 94.

Controller 94 is additionally connected by signal circuit 97 and actuates recycle control valve 74; is connected by a signal circuit 93 to a recycle blocking valve 92 located in piping 73 of recycle system 72; and is connected by a signal circuit 91 to normal control valve 58.

As the level of condensate in heater 36 rises, controller 94 of recycle system 72 opens recycle valve 74. If the level continues to rise after recycle valve 74 is near fully open, controller 94 opens normal control valve 58. In similar manner, as the level of condensate in heater 36 drops, controller 94 first closes normal control valve 58 and then recycle control valve 74.

Remembering the preceding discussion of FIG. 3, when flow drops below about 75 percent, recycle system 72 ceases to function and check valve 76 closes to prevent backflow into heater 36. Condensate continues to collect in heater 36 increasing the level, because there is no outlet through recycle system 72. Controller 94 responds to this increase in level by opening normal control valve 58. Thus, at flows below about 75 percent, the power plant reverts to operation as in the prior art.

As flow rises above about 75 percent, check valve 76 reopens and condensate from heater 36 passes through recycle system 72, as well as through normal control valve 58. The level of condensate in heater 36 drops, because there is now an increase in the draining capacity. Controller 94 responds to the drop in level by closing normal control valve 58 until all of the condensate is draining through recycle system 72.

Controller 94 will monitor the temperature measured by temperature sensor 96. If this temperature should rise above some defined value, perhaps due to a failure in heater 36, controller 94 will close recycle blocking valve 92 to prevent an unsafe increase in the temperature of the water at the inlet to feedpump 34. The level of condensate in heater 36 will rise, because the drain path is blocked by recycle blocking valve 92. Controller 94 will respond to this rise in level by opening normal control valve 58.

In a first alternative embodiment of the invention, not shown, recycle control valve 74 may be actuated by controller 94 to perform both its previously described functions and also those of recycle blocking valve 92. This alternative embodiment would eliminate the need for separate blocking valve 92, with possible savings in the cost of building this invention.

Figure 5:
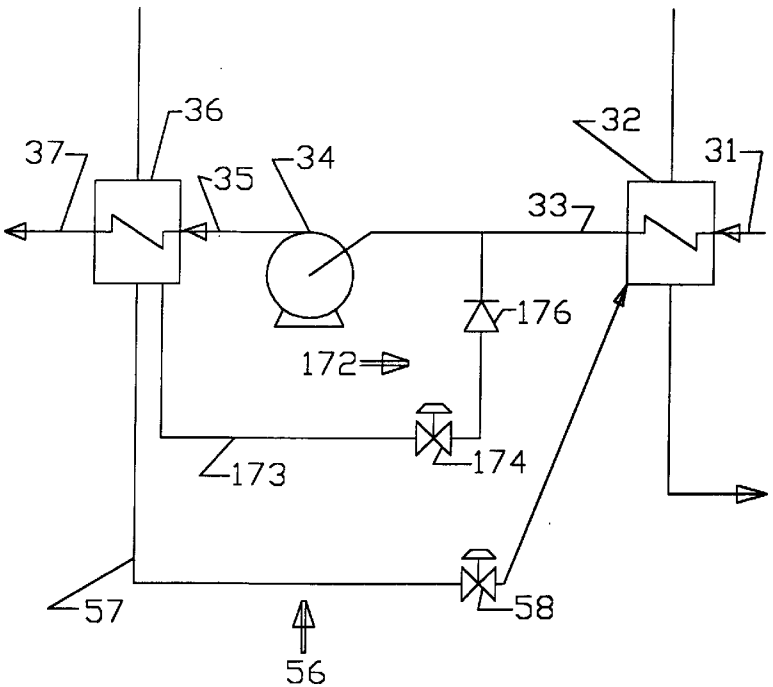
FIG. 5 is a simplified,functional representation of an alternative recycle system according to the invention in which the recycle system is connected directly to the shell of a feedwater heater, rather than to a heater drain system.

FIG. 5 illustrates another alternative embodiment of the invention. In this embodiment, a recycle system 172 is connected through a separate line 173 to the shell of feedwater heater 36, rather than through a portion of drain system 56. Recycle system 172 includes a recycle control valve 174 and a check valve 176 disposed in line 173, which is connected at its opposite end to line 33 which extends between heater 32 and feedpump 34.

It will be understood that the above description of the present invention is subject to various modifications, changes, and adaptations, and that the same are intended to be comprehended within the range of equivalents of the appended claims.

I claim:

1. In a steam power plant including a boiler, a steam turbine, a plurality of feedwater heaters interconnected by feedwater piping, and a feedwater pump, with said feedwater pump located downstream of a closed feedwater heater, with one or more closed feedwater heaters downstream of said feedwater pump, and with the feedwater heater immediately upstream of the feedwater pump serving as a receiving vessel for condensate draining from the feedwater heater immediately downstream of the feedwater pump through drain piping, the improvement comprising a connection, consisting of piping and valves, between the feedwater heater immediately downstream of the feedwater pump and the feedwater piping that connects the feedwater pump and the feedwater heater immediately upstream, allowing the draining condensate to flow into said feedwater piping without the assistance of a pump.

2. In a power plant as in claim 1, including a water level sensor installed in the feedwater heater downstream of the feedwater pump, a water level controller, and at least two control valves, with a normal control valve installed in the drain piping connecting the feedwater heater downstream of the feedwater pump to the feedwater heater upstream of the feedwater pump, and a drain recycle control valve installed in the piping connecting the feedwater heater downstream of the feed pump to the feedwater piping immediately upstream of the feedwater pump, regulating the level in the feedwater heater with the level sensor by opening in sequence first the recycle valve, and second the normal control valve, until the amount of water flowing through the two valves is equal to the amount of condensate produced in the feedwater heater so that the water level remains at a defined value.

3. In a power plant as in claim 1, including at least one check valve, installed in the piping connecting the feedwater heater downstream of the feedwater pump and the feedwater piping immediately upstream of the feedwater pump and disposed in series with the recycle control valve for preventing flow from said feedwater piping into the feedwater heater downstream of the feedwater pump.

4. In a power plant as in claim 1, including a temperature sensor for measuring the temperature in the drain piping leaving the feedwater heater downstream of the feedwater pump, a controller, and a recycle control valve, with the controller causing the closure of said recycle control valve when the measured temperature in the drain piping exceeds a defined value.

5. In a power plant as in claim 1, including a temperature sensor for measuring the temperature in the drain piping leaving the feedwater heater downstream of the feedwater pump, a controller, and a blocking valve installed in series with the recycle control valve, with the controller causing the closure of said blocking valve when the measured temperature in the drain piping exceeds a defined value.

* * * * *